US005726447A

United States Patent [19]

Aisawa et al.

[11] Patent Number: 5,726,447

[45] Date of Patent: Mar. 10, 1998

[54] IONIZATION CHAMBER AND MASS SPECTROMETER HAVING A CORONA NEEDLE WHICH IS EXTERNALLY REMOVABLE FROM A CLOSED IONIZATION CHAMBER

[75] Inventors: Edward Aisawa, Sunnyvale; James L. Bertsch, Palo Alto; J. Michael Flanagan, Sunnyvale; Darrell L. Gourley, San Francisco; Val C. Robinson, Morgan Hill; Joseph Vandenburg, Mountain View, all of Calif.

[73] Assignee: Hewlett-Packard Company, Palo Alto, Calif.

[21] Appl. No.: 679,647

[22] Filed: Jul. 12, 1996

[51] Int. Cl.[6] ..... H01J 49/10

[52] U.S. Cl. ..... 250/288

[58] Field of Search ..... 250/288, 288 A, 250/324; 361/230

[56] References Cited

U.S. PATENT DOCUMENTS

| | | | |
|---|---|---|---|
| 4,137,750 | 2/1979 | French et al. | 72/23 |
| 4,546,253 | 10/1985 | Tsuchiya et al. | 250/288 |
| 5,051,583 | 9/1991 | Mimura et al. | 250/288 |

FOREIGN PATENT DOCUMENTS 4-215329 8/1992 Japan .

OTHER PUBLICATIONS

Garcia, D.M. et al., "Opitimization of the Atmospheric Pressure Chemical Ionization Liquid Chromatography Mass Spectrometry Interface", J. Am. Soc. Mass. Spectrom. vol. 7, No. 1, 1996, pp. 59–65.

Hagiwara, T. et al., "Optimum Needle Materials of the Corona Discharge Electrode for Quantitative Analysis by Liquid Chromatography/Atmospheric Pressure Chemical Ionization–Mass Spectrometry", J. Mass Spectrom. Soc. Jpn., vol. 43, No. 6, 1995, pp. 365–371.

Takada, Y. et al., "Atmospheric Pressure Chemical Ionization Interface for Capillary Electrophoresis/Mass Spectrometry", Anal. Chem., vol. 67, No. 8, Apr. 15, 1995, pp. 1474–1476.

Doerge, D.R. et al, "Multiresidue Analysis of Sulforamides Using Liquid Chromatography with Atmospheric Pressure Chemical Ionization Mass Spectrometry", Rapid Communications in Mass Spectrom. vol. 7, No. 12, Dec. 1993, pp. 1126–1130.

Kambara, H. et al., "Ionization Characteristics of Atmospheric Pressure Ionization by Corona Discharge", Mass Spectroscopy, vol. 24, No. 3, Sep. 1976, pp. 229–236.

*Primary Examiner*—Jack I. Berman

*Attorney, Agent, or Firm*—Janet Pauline Clark

[57] ABSTRACT

The invention relates to an ionization chamber. More particularly, the invention relates to a mass spectrometer system having an ionization chamber incorporating a corona needle removable from outside the closed ionization chamber. In preferred embodiments, the corona needle is self-positioning and engages and disengages operational or safety electrical connections.

36 Claims, 3 Drawing Sheets

IONIZATION CHAMBER AND MASS SPECTROMETER HAVING A CORONA NEEDLE WHICH IS EXTERNALLY REMOVABLE FROM A CLOSED IONIZATION CHAMBER

The present invention relates to an ionization chamber. More particularly, the present invention relates to a mass spectrometer system having an ionization chamber incorporating a corona needle which is removable from outside of a closed ionization chamber.

BACKGROUND

Mass spectrometers employing ionization chambers, such as atmospheric pressure chemical ionization (APCI) chambers, have been demonstrated to be particularly useful for obtaining mass spectra from liquid or gaseous samples and have widespread application. Mass spectrometry (MS) is frequently used in conjunction with gas chromatography (GC) or liquid chromatography (LC), and combined GC/MS and LC/MS systems am commonly used in the analysis of analytes having a wide range of polarities and molecular weights. Combined LC/MS systems have been particularly useful for applications such as environmental monitoring, pharmaceutical analysis, industrial process and quality control, and the like.

APCI may be used in conjunction with gaseous or liquid samples. In APCI-MS, in one preferred operating mode, a liquid sample containing mobile phase (solvent) and analyte is converted from liquid to vapor phase, followed by ionization of the mobile phase and analyte. Such systems frequently employ nebulizers, optionally with pneumatic, ultrasonic, or thermal "assists", to break up the stream of liquid entering the nebulizer into fine, relatively uniform-sized droplets which are then vaporized. Ionization of the vaporized mobile phase and analyte molecules occurs under the influence of a corona discharge generated within the APCI chamber by an electrically conductive corona needle to which a high voltage electrical potential is applied. In APCI with liquid samples, the mobile phase molecules serve the same function as the reagent gas in chemical ionization mass spectrometry (CIMS). The mobile phase molecules are ionized by passing through a high electric field gradient or corona discharge created at the tip of the corona needle (electrode). The ionized mobile phase molecules then ionize the analyte molecules. The exact chemical reactions and resulting ions depend upon the composition of the mobile phase, whether APCI is operated in positive or negative mode, and the chemical nature of the analyte. More than one type of ion may be formed, leading to multiple mechanisms for ionization of the analyte. A fraction of the ionized analyte and solvent molecules are separated from vaporized and non-ionized solvent molecules and are subsequently focussed and analyzed by conventional MS techniques.

In order for a corona discharge to occur and remain stable, it is important that the corona needle remain clean, sharp, and electrically conductive. Especially when system performance degrades, when arcing takes place at reduced voltages, or when the corona needle is dirty or visibly damaged, it is necessary to remove the corona needle from the ionization chamber for cleaning, sharpening, or replacement. Depending upon the analytes evaluated, it may be necessary or desirable to perform corona needle maintenance on even a daily basis to maintain optimum performance of the system.

Prior art designs require that the ionization chamber be opened or disassembled in order for the corona needle to be removed. This is a significant disadvantage, requiring time-consuming disassembly and reassembly of the ionization chamber. Furthermore, because the APCI vaporizer operates at elevated temperatures, such as up to about 500 degrees Celsius, generally up to about one hour must be allowed for cool down of the ionization chamber before it can be safely opened or disassembled and the corona needle removed. Some prior art designs also require the vacuum to be "broken" and the mass spectrometer vented in order to open the ionization chamber. Therefore, the corona needle is often not removed for cleaning, sharpening, or replacement as frequently as needed to maintain optimum performance, due to the inconvenience and down time associated with cool down, opening, or disassembly of the ionization chamber.

What is needed is an APCI chamber with a corona needle that is quickly and conveniently removable for periodic maintenance, such as for inspection, cleaning, sharpening, or replacement, without the need to cool down, open, or disassemble and reassemble the APCI chamber.

SUMMARY OF THE INVENTION

In one embodiment, the invention relates to an ionization chamber comprising: a housing containing at least one ionization region, a corona needle positioned such that the tip of the needle is within the ionization region, a counter electrode positioned such that the electric potential between the needle and the counter electrode is sufficient to create a corona discharge or high electric field gradient in the vicinity of the needle tip for the purpose of ionizing molecules, and means of forming a seal between the needle and the ionization chamber or housing; wherein the needle is removable from outside of the closed ionization chamber.

In another embodiment, the invention relates to a mass spectrometer system having an ionization chamber comprising: a housing containing at least one ionization region, a corona needle positioned such that the tip of the needle is within the ionization region, a counter electrode positioned such that the electric potential between the needle and the counter electrode is sufficient to create a corona discharge or high electric field gradient in the vicinity of the needle tip for the purpose of ionizing molecules, and means of forming a seal between the needle and the ionization chamber or housing; wherein the needle is removable from outside of the closed ionization chamber.

In a preferred embodiment, the ionization region is substantially at or near atmospheric pressure. In a preferred embodiment, the corona needle is self-positioning. These and other embodiments of the invention are described hereinafter.

DETAILED DESCRIPTION

Figure 1:
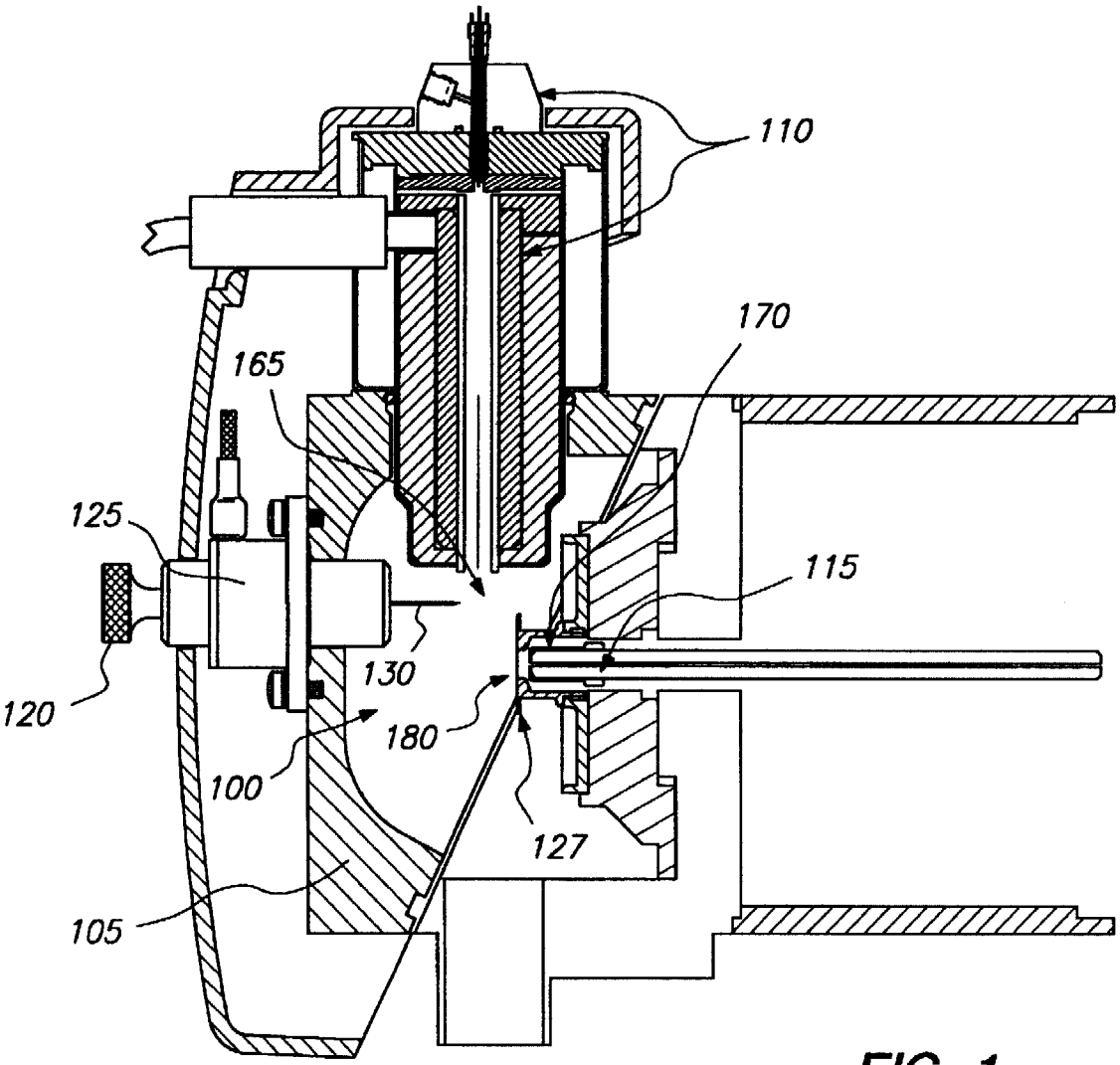
FIG. 1 is a schematic drawing of a preferred ionization chamber of the invention.

In FIG. 1, an ionization chamber (100) comprises a housing (105) containing at least one ionization region, for example, an atmospheric pressure chemical ionization region, optionally a nebulizer/vaporizer assembly (110) for vaporizing samples, optionally a capillary assembly (115) for communicating to a mass analyzer, a corona needle assembly (120), a corona needle receptacle (125), and a counter electrode (127). A corona discharge is created at the tip of the corona needle (130) under the influence of an electric potential generated between the corona needle (130) and the counter electrode (127). The nebulizer/vaporizer assembly (110) and capillary assembly (115) are shown arranged in a substantially orthogonal or cross-flow configuration; in such orientation, the angle between the axial centerlines of the nebulizer/vaporizer assembly (110) and the capillary assembly (115) is preferably between about 75 degrees and about 105 degrees, more preferably at or about 90 degrees. However, other configurations are possible such as orientations which are substantially linear (axial), angular, or off-axis.

Figure 2:
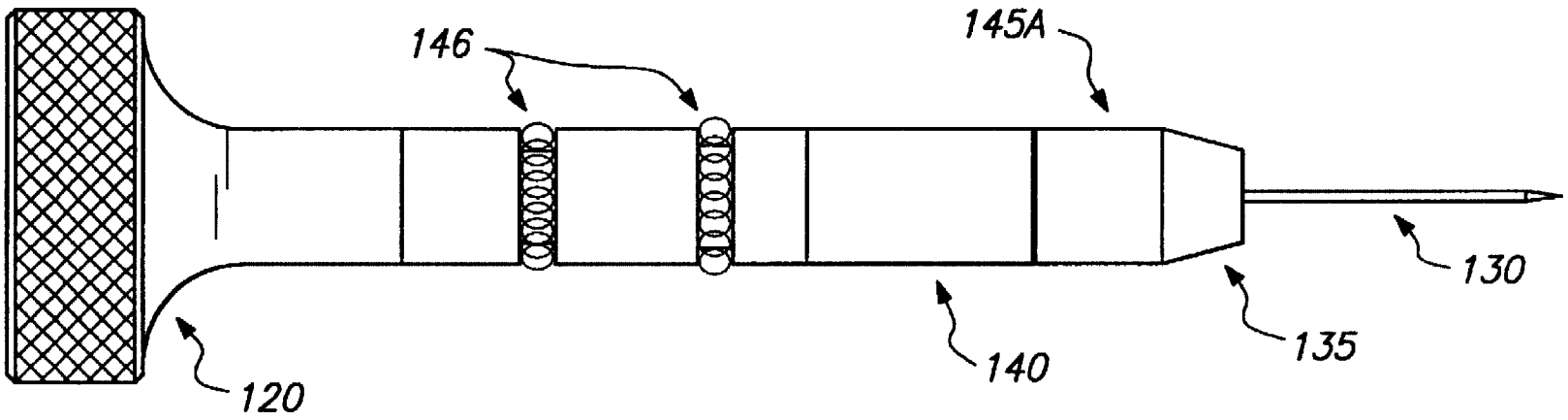
FIGS. 2 and 3 are schematic drawings of a preferred corona needle assembly and receptacle used in the preferred ionization chamber illustrated in FIG. 1.

As illustrated in FIG. 2, the corona needle assembly (120) comprises a corona needle (130), optional securing means such as a cap or nut (135), optional needle mount or sleeve (140), means of receiving electrical power for the corona needle such as an electrical sleeve (145A), and optional means of indicating the presence of the corona needle assembly or optional means of providing safety interlocks for the high voltage corona needle power supply such as low voltage interlocks (146).

Figure 3:
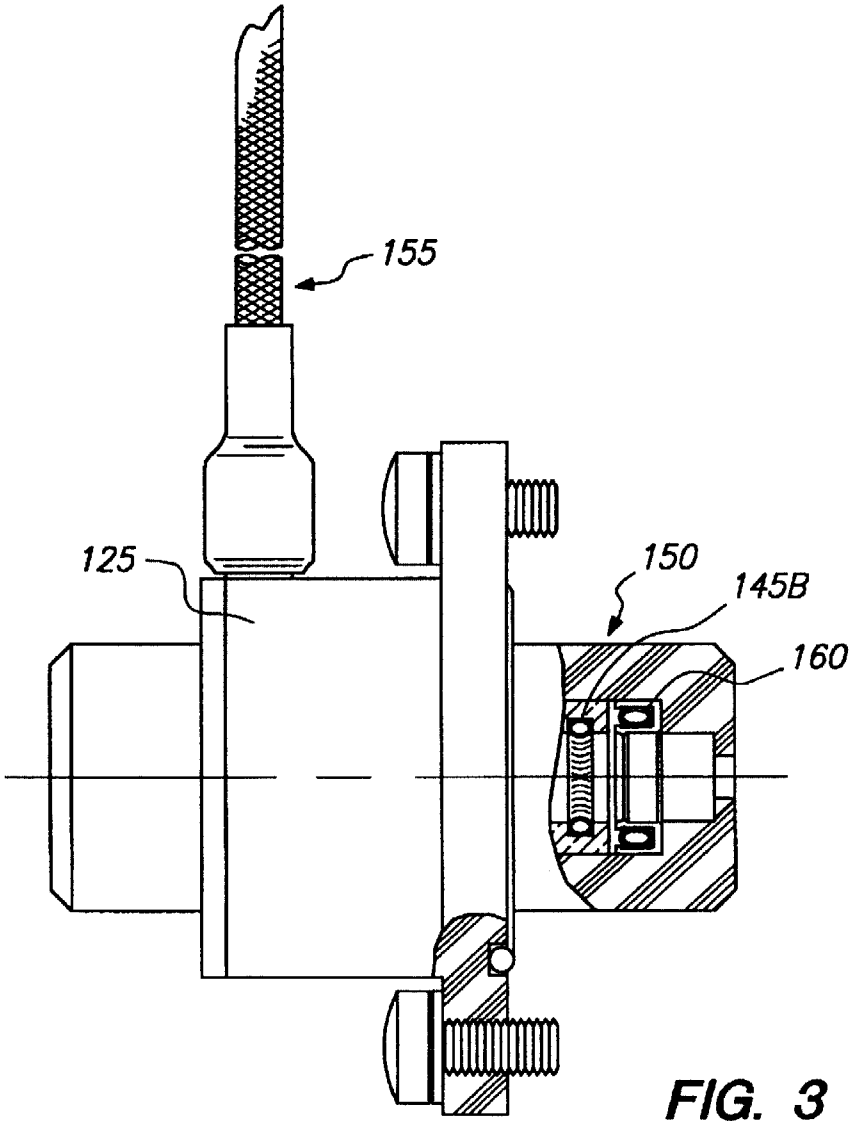

As illustrated in FIG. 3, the corona needle receptacle (125) comprises a receptacle (150) into which the corona needle assembly mates, optional electrical contacts (145B), optional electrical leads supplying electrical power (155), optional seals (160), and optional high voltage interlock sensors (not shown).

As illustrated in FIG. 2, power to the corona needle assembly (120) is supplied through an electrical sleeve (145A) connected directly to the needle assembly, along with electrical or mechanical safety interlocks (146). In the preferred embodiment illustrated in FIGS. 2 and 3, power to the corona needle assembly (120) is supplied via the electrical leads (155) connecting to the needle receptacle (125) making physical contact with the safety interlocks (146) and the corona needle (130) on the needle assembly (120). Preferably safety interlocks are provided such that high voltages are removed or disconnected when the corona needle assembly (120) is withdrawn or removed from the needle receptacle (125). In a preferred embodiment, for safety reasons, the needle receptacle is sized so as to avoid possible contact with parts of the human body in order to further eliminate or reduce shock hazards. In such preferred embodiments, the inner diameter of the needle receptacle is less than about 12 millimeters, more preferably less than about 6 millimeters.

As illustrated in FIG. 1, the corona needle receptacle (125) is positioned within or may optionally be fabricated as part of the ionization chamber (100) or housing (105) such that the corona needle (130) is properly positioned with respect to the exit nozzle (165) of the nebulizer/vaporizer assembly (110) and the entrance opening (180) of the capillary assembly (115). In certain embodiments, the corona needle is "self-positioning", that is, the needle assembly (120) and needle receptacle (125) are fabricated so as to automatically, accurately, and precisely position the tip of the corona needle (130) in a fixed position relative to the entrance opening (180) of the capillary assembly (115) and the counter electrode (127) when the needle assembly (120) is placed in the needle receptacle (125).

The ionization chamber may be fabricated from any material providing the requisite structural integrity and which does not significantly degrade, corrode, deform, or outgas under typical conditions of use. Typical ionization chambers are fabricated from materials including metals such as stainless steel, aluminum, and aluminum alloys, glass, ceramics, and plastics such as Delrin acetal resin (trademark of Du Pont) and Teflon fluorocarbon polymer (trademark of Du Pont). Composite or multilayer materials may also be used. In a preferred embodiment, the housing is fabricated from an aluminum alloy.

The nebulizer/vaporizer assembly is typically fabricated from stainless steel. The vaporizer is typically heated during operation to temperatures in the range of about 100 degrees Celsius to about 500 degrees Celsius.

The capillary assembly is typically fabricated from borosilicate glass such as Pyrex glass (trademark of Corning).

The corona needle comprises a sharp tip and may be fabricated from a hollow or solid shaft, preferably a solid shaft. The size of the corona needle shaft may vary, with typical diameters ranging from about 0.2 millimeters to about 2.0 millimeters. The corona needle is preferably fabricated from a material which is electrically conductive, durable, and resistant to degradation or corrosion under conditions of use, such as stainless steel, nichrome, inconel, and monel. The means of securing the needle may be fabricated from, for example, stainless steel, and is used to mount the needle onto the needle mount or sleeve. The needle mount or sleeve may be fabricated from, for example, stainless steel. In an alternate embodiment, the needle, means of securing the needle, and the needle mount or sleeve may be formed or fabricated as a single piece and references to corona needle or needle assemblies herein may refer to embodiments including single and multiple piece assemblies.

As illustrated in FIGS. 2 and 3, the needle assembly and needle receptacle are fabricated such that the needle assembly mates or fits within the needle receptacle. The tolerances may be fixed such that the needle assembly fits within the needle receptacle such that under tension a sliding or lateral motion is enabled while still providing sufficient sealing such that minimal leakage occurs out of the ionization chamber during operation. In a preferred embodiment, optional sealing means, such as spring loaded Teflon fluorocarbon polymer (trademark of Du Pont) seals known as Bal seals (trademark of Bal Seal Engineering Company, Inc.), or similar seals, may be employed to seal the needle assembly within the needle receptacle such that when tension is applied to the needle assembly, such as by pulling, a sliding or lateral motion enables the needle assembly to be removed from the needle receptacle from outside of the closed ionization chamber. In a preferred embodiment wherein the corona needle assembly is self-positioning, typical tolerances between the tip of the corona needle and the counter electrode are on the order of up to about 0.5 millimeters, more preferably on the order of up to about 0.2 millimeters.

With reference to FIG. 1, during operation, a liquid sample containing analyte is nebulized and vaporized in the nebulizer/vaporizer assembly (110) and is introduced into the ionization chamber (100) via the exit nozzle (165). Liquid flow rates are typically in the range from about 1 microliter/minute to about 5000 microliters/minute, more preferably from about 5 microliters/minute to about 2000 microliters/minute. The ionization chamber (100) is preferably operated substantially at or near atmospheric pressure, that is, typically from about 660 torr to about 860 torr, preferably at or about 760 torr Operation above or below atmospheric pressure is possible and may be desirable in certain applications. The source of the liquid sample may optionally be a liquid chromatograph, flow injector, syringe pump, infusion pump, or other means of providing a liquid sample (not shown).

A high voltage potential is applied to the electrically conductive corona needle (130) via electrical contacts and/or electrical leads, and a corona discharge field is generated within the ionization chamber (100). The electric potential between the corona needle (130) and the counter electrode (127) is typically in the range from about 1 kV to about 10 kV, preferably in the range from about 1 kV to about 6 kV, whether operating in positive or negative mode. The sample is ionized under the influence of the generated field. The ions are optionally desolvated under the influence of drying gas introduced via the space (170) around the capillary assembly (115). The ions exit the ionization chamber (100) via an entrance opening (180) to the capillary assembly (115) and subsequently enter into vacuum and/or mass analyzer chamber(s), not shown. Any suitable mass analyzers may be used, including but not limited to quadrupole or multipole, ion trap, Fourier transform, time-of-flight, and sector (magnetic/electric) mass analyzers.

The corona needle assembly is easily and conveniently removed, such as for inspection, cleaning, sharpening, or replacement with a new corona needle or new corona needle assembly, from outside of the closed ionization chamber, without cooling down, opening, or disassembling the ionization chamber. As used herein, closed ionization chamber means an ionization chamber which is substantially enclosed and separated from or sealed with respect to the outside or external environment but which does not necessarily provide a liquid or gas tight seal. In a preferred embodiment, the closed ionization chamber provides liquid and/or gas tight sealing from the outside or external environment.

In order to remove the corona needle assembly, tension is applied, such as by pulling, on the end of the needle assembly to withdraw the needle assembly from the needle receptacle. Applying tension to the end of the needle assembly enables a sliding or lateral motion with respect to the needle receptacle. In a preferred embodiment, withdrawing the needle assembly simultaneously breaks the electrical contacts and disengages or deenergizes the high voltage connection supplying power to the corona needle. Such mechanical or electrical safety interlocks may be implemented via hardware, system software, or both.

Once inspected, cleaned, or sharpened, the needle assembly or a replacement needle assembly is inserted into the needle receptacle by applying pressure or pushing the needle assembly into the needle receptacle, so as to enable a sliding or lateral motion of the needle assembly relative to the needle receptacle. In a preferred embodiment, the corona needle is self-positioning. Preferably, when the corona needle assembly is inserted into the needle receptacle, the high voltage connections supplying power to the corona needle are simultaneously reengaged or reenergized.

Having thus described exemplary embodiments of the invention, it will be apparent that further alterations, modifications, and improvements will also occur to those skilled in the art. Further, it will be apparent that the present invention is not limited to the specific embodiments described herein. Such alterations, modifications, and improvements, though not expressly described or mentioned herein, are nonetheless intended and implied to be within the spirit and scope of the invention. Accordingly, the foregoing discussion is intended to be illustrative only; the invention is limited and defined only by the various following claims and equivalents thereto.

We claim:

1. A mass spectrometer system having an ionization chamber comprising:

(a) a housing containing at least one ionization region;

(b) a corona needle positioned such that the tip of the needle is within the ionization region wherein the corona needle is part of a needle assembly;

(c) a counter electrode positioned such that the electric potential between the needle and the counter electrode is sufficient to create a corona discharge or high electric field gradient in the vicinity of the needle tip for the purpose of ionizing molecules, and d) means of forming a seal between the needle assembly and the needle receptacle;

wherein the needle assembly is mated with a needle receptacle, both of which are fabricated so as to automatically, accurately and precisely position the tip of the corona needle in a fixed position relative to the counter electrode and wherein the needle assembly is slidably removable from the needle receptacle from outside of the closed ionization chamber.

2. The system of claim 1 wherein the electric potential between the corona needle and the counter electrode is in the range from about 1 kV to about 10 kV.

3. The system of claim 1 wherein the ionization region is substantially at or near atmospheric pressure.

4. The system of claim 1 wherein the needle comprises a solid shaft.

5. The system of claim 4 wherein the needle is comprised of a material selected from stainless steel, nichrome, inconel, or monel.

6. The system of claim 1 wherein removal of the needle assembly from the needle receptacle simultaneously breaks electrical contacts by which power is supplied to the corona needle.

7. The system of claim 1 wherein the means of forming a seal comprises spring-loaded fluorocarbon polymer seals for sealing laterally moving surfaces.

8. The system of claim 7 further comprising:

(e) means for supplying electrical power to the corona needle, wherein lateral motion mechanically or electrically engages and disengages operational or safety interlocks.

9. The system of claim 8 further comprising:

(f) a nebulizer/vaporizer assembly for vaporizing sample; and (g) a capillary assembly for communicating to a mass analyzer.

10. The system of claim 9 wherein the nebulizer/vaporizer assembly and the capillary assembly are arranged in a substantially cross-flow orientation.

11. The system of claim 1 further comprising:

a liquid chromatograph.

12. The system of claim 11 further comprising:

a mass analyzer.

13. The system of claim 11 wherein the mass analyzer is an electric or magnetic sector, quadrupole or multipole, ion trap, Fourier transform, or time-of-flight mass analyzer.

14. The system of claim 1 wherein the means of forming a seal comprises fixed tolerances between the needle assembly within the needle receptacle such that under tension a sliding or lateral motion is enabled while still providing sufficient sealing such that minimal leakage occurs out of the ionization chamber during operation.

15. An ionization chamber comprising:

(a) a housing containing at least one ionization region;

(b) a corona needle positioned such that the tip of the needle is within the ionization region, wherein the corona needle is part of a needle assembly;

(c) a counter electrode positioned such that the electric potential between the needle and the counter electrode is sufficient to create a corona discharge or high electric field gradient in the vicinity of the needle tip for the purpose of ionizing molecules;

(d) means of forming a seal between the needle assembly and the needle receptacle; wherein the needle assembly is mated with a needle receptacle of said housing and both said needle assembly and said needle receptacle are fabricated so as to automatically, accurately and precisely position the tip of the corona needle in a fixed position relative to the counter electrode and wherein the needle assembly is removable from the needle receptacle from outside of the closed ionization chamber; and (e) means for supplying electrical power to the corona needle, wherein removal of the needle assembly from the needle receptacle simultaneously breaks electrical contacts by which power is supplied to the corona needle.

16. The chamber of claim 15 wherein the electric potential between the corona needle and the counter electrode is in the range from about 1 kV to about 10 kV.

17. The chamber of claim 15 wherein the ionization region is substantially at or near atmospheric pressure.

18. The chamber of claim 15 wherein the needle comprises a solid shaft.

19. The chamber of claim 18 wherein the needle is comprised of a material selected from stainless steel, nichrome, inconel, or monel.

20. The chamber of claim 15 wherein the means of forming a seal comprises spring-loaded fluorocarbon polymer seals for sealing laterally moving surfaces.

21. The chamber of claim 20 wherein lateral motion of the needle assembly mechanically or electrically engages and disengages operational or safety interlocks to simultaneously break electrical contacts by which power is supplied to the corona needle.

22. The chamber of claim 21 further comprising:

(f) a nebulizer/vaporizer assembly for vaporizing sample; and (g) a capillary assembly for communicating to a mass analyzer.

23. The chamber of claim 22 wherein the nebulizer/vaporizer assembly and the capillary assembly are arranged in a substantially cross-flow orientation.

24. The chamber of claim 15 wherein the means of forming a seal comprises fixed tolerances between the needle assembly within the needle receptacle such that under tension a sliding or lateral motion is enabled while still providing sufficient sealing such that minimal leakage occurs out of the ionization chamber during operation.

25. An ionization chamber comprising:

(a) a housing containing at least one ionization region;

(b) a corona needle;

(c) a needle assembly, onto which the corona needle is mounted;

(d) a needle receptacle, into which the needle assembly mates;

(e) a counter electrode positioned such that the electric potential between the needle and the counter electrode is sufficient to create a corona discharge or high electric field gradient in the vicinity of the needle tip for the purpose of ionizing molecules; and (f) a spring-loaded seal between the needle assembly and the needle receptacle or housing;

wherein the needle assembly is removable from the needle receptacle from outside of the closed ionization chamber.

26. The chamber of claim 25 wherein the ionization region is substantially at or near atmospheric pressure.

27. The chamber of claim 25 wherein the electric potential between the corona needle and the counter electrode is in the range from about 1 kV to about 10 kV.

28. The chamber of claim 25 wherein the needle comprises a solid shaft.

29. The chamber of claim 25 wherein the needle is self-positioning.

30. The chamber of claim 25 wherein the spring-loaded seal comprises spring-loaded fluorocarbon polymer seals for sealing laterally moving surfaces.

31. The chamber of claim 30 further comprising:

(g) means for supplying electrical power to the corona needle, wherein lateral motion mechanically or electrically engages and disengages operational or safety interlocks.

32. The chamber of claim 31 further comprising:

(h) a nebulizer/vaporizer assembly for vaporizing sample; and (i) a capillary assembly for communicating to a mass analyzer.

33. The chamber of claim 32 wherein the nebulizer/vaporizer assembly and the capillary assembly are arranged in a substantially cross-flow orientation.

34. The chamber of claim 25 wherein the means of forming a seal comprises fixed tolerances between the needle assembly within the needle receptacle such that under tension a sliding or lateral motion is enabled while still providing sufficient sealing such that minimal leakage occurs out of the ionization chamber during operation.

35. A mass spectrometer system having an ionization chamber comprising:

(a) a housing containing at least one ionization region;

(b) a corona needle positioned such that the tip of the needle is within the ionization region;

(c) a counter electrode positioned such that the electric potential between the needle and the counter electrode is sufficient to create a corona discharge or high electric field gradient in the vicinity of the needle tip for the purpose of ionizing molecules; and d) means of forming a seal between the needle assembly and the needle receptacle comprising spring-loaded fluorocarbon polymer seals for sealing laterally moving surfaces;

wherein the needle assembly is removable from the needle receptacle from outside of the closed ionization chamber.

36. A mass spectrometer system having an ionization chamber comprising:

(a) a housing containing at least one ionization region;

(b) a corona needle positioned such that the tip of the needle is within the ionization region;

(c) a counter electrode positioned such that the electric potential between the needle and the counter electrode is sufficient to create a corona discharge or high electric field gradient in the vicinity of the needle tip for the purpose of ionizing molecules; and d) means of forming a seal between the needle assembly and the needle receptacle comprising fixed tolerances between the needle assembly within the needle receptacle such that under tension a sliding or lateral motion is enabled while still providing sufficient sealing such that minimal leakage occurs out of the ionization chamber during operation, wherein the needle assembly is removable from the needle receptacle from outside of the closed ionization chamber.

* * * * *